US010408241B2

(12) United States Patent
Kenkel et al.

(10) Patent No.: US 10,408,241 B2
(45) Date of Patent: *Sep. 10, 2019

(54) METHOD OF DETERMINING CYCLE TIME OF AN ACTUATOR AND A SYSTEM FOR DETERMINING A CYCLE TIME OF A MACHINE HAVING AN ACTUATOR

(71) Applicant: DEERE & COMPANY, Moline, IL (US)

(72) Inventors: Aaron R. Kenkel, East Dubuque, IL (US); David J. Myers, Dubuque, IA (US); Doug M. Lehmann, Durango, IA (US); Scott R. Stahle, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/933,478

(22) Filed: Mar. 23, 2018

(65) Prior Publication Data

US 2019/0093683 A1 Mar. 28, 2019

Related U.S. Application Data

(63) Continuation-in-part of application No. 15/428,562, filed on Feb. 9, 2017, now Pat. No. 10,125,475.

(51) Int. Cl.

| | |
|---|---|
| ***F15B 15/28*** | (2006.01) |
| ***E02F 9/26*** | (2006.01) |
| ***E02F 3/43*** | (2006.01) |

(52) U.S. Cl.

CPC ..... *F15B 15/2815* (2013.01); *E02F 3/43* (2013.01); *E02F 9/264* (2013.01)

(58) Field of Classification Search

CPC ..... F15B 15/2815; E02F 9/264; E02F 3/43; E02F 9/26; E02F 9/2004; E02F 9/268; E02F 3/283; E02F 3/961; G07C 5/0841; G04F 10/00

See application file for complete search history.

(56) References Cited

U.S. PATENT DOCUMENTS

| | | | |
|---|---|---|---|
| 5,955,706 | A | 9/1999 | Fonkalsrud et al. |
| 7,124,057 | B2 | 10/2006 | Forster et al. |
| 8,185,290 | B2 | 5/2012 | Mintah et al. |
| 8,775,035 | B2 | 7/2014 | Sherlock et al. |
| 9,128,008 | B2 | 9/2015 | Tabor |
| 9,347,763 | B2 | 5/2016 | Ikegami et al. |
| 2016/0138240 | A1 | 5/2016 | Ikegami et al. |
| 2017/0138018 | A1 | 5/2017 | Beschomer et al. |
| 2017/0255895 | A1 | 9/2017 | Kozumi et al. |

FOREIGN PATENT DOCUMENTS

| | | | |
|---|---|---|---|
| EP | 1736841 | A1 | 12/2006 |

*Primary Examiner* — Russell Frejd

(57) ABSTRACT

In accordance with an example embodiment, a method includes monitoring a position of an actuator during operation of the actuator, determining that an actuator command value is greater than an actuator command value threshold, starting a timer upon a movement of the actuator through a starting position during the operation of the actuator at the actuator command value, determining satisfaction of at least one condition, and stopping the timer upon satisfaction of the at least one condition and movement of the actuator through an ending position.

20 Claims, 4 Drawing Sheets

METHOD OF DETERMINING CYCLE TIME OF AN ACTUATOR AND A SYSTEM FOR DETERMINING A CYCLE TIME OF A MACHINE HAVING AN ACTUATOR

RELATED APPLICATIONS

This application is a continuation-in-part of U.S. application Ser. No. 15/428,562, titled Method of Testing Cycle Time of an Implement on a Work Machine and System thereof, filed Feb. 9, 2017, and issued as U.S. Pat. No. 10,125,475, which is hereby incorporated by reference in its entirety.

TECHNICAL FIELD

The present disclosure generally relates to a system and method of operating a machine. An embodiment of the present disclosure relates to a system and method of determining a cycle time of an actuator of a machine.

BACKGROUND

Many work machines, such as a loader, include one or more implements capable of performing a work function and/or one or more steering mechanisms to steer the machine. For example, a loader may include a boom and a bucket. During operation, the boom can raise and lower the bucket to perform a digging function. Implement and steering features are often controlled by a hydraulic actuator. To ensure desirable operation of the actuator, an operator or service technician can execute a cycle time test on the actuator. To do so, the operator or technician uses a stopwatch or a clock to run the test. The cycle time test may be performed in the field or on a test stand during an assembly process.

While the use of a stopwatch or a clock located nearby is often used, it does lead to some inaccuracies between measurements. In particular, the operator may not start or stop the test at the same point between two individual tests. Moreover, two different operators may run the cycle time test differently. With timing discrepancies inherent in the manner by which the test is performed, it can be difficult to diagnose possible problems in the field or with a newly built machine on a test stand. Additionally, the time taken to conduct a cycle time test results in machine downtime for the machine.

Therefore, there exists a need in the art for a reliable system and method for determining one or more accurate cycle times of an actuator that reduce interruption of machine operation.

SUMMARY

Various aspects of embodiments of the present disclosure are set out in the claims.

According to a first aspect of the present disclosure, a method includes monitoring a position of an actuator during operation of the actuator, determining that an actuator command value is greater than an actuator command value threshold, starting a timer upon a movement of the actuator through a starting position during the operation of the actuator at the actuator command value, determining satisfaction of at least one condition, and stopping the timer upon satisfaction of the at least one condition and movement of the actuator through an ending position.

According to a second aspect of the present disclosure, a system is provided for determining a cycle time of a machine having an actuator configured to operate at least between a first threshold position and a second threshold position. The system includes a controller configured to continuously monitor a position of an actuator during operation of the machine, determine satisfaction of a first condition, measure, upon monitoring the position of the actuator operating from the first threshold position to the second threshold position, a time for the actuator to operate from the first threshold position to the second threshold position, and determine a cycle time of the actuator based upon the actuator operating from the first threshold position to the second threshold position.

The above and other features will become apparent from the following description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
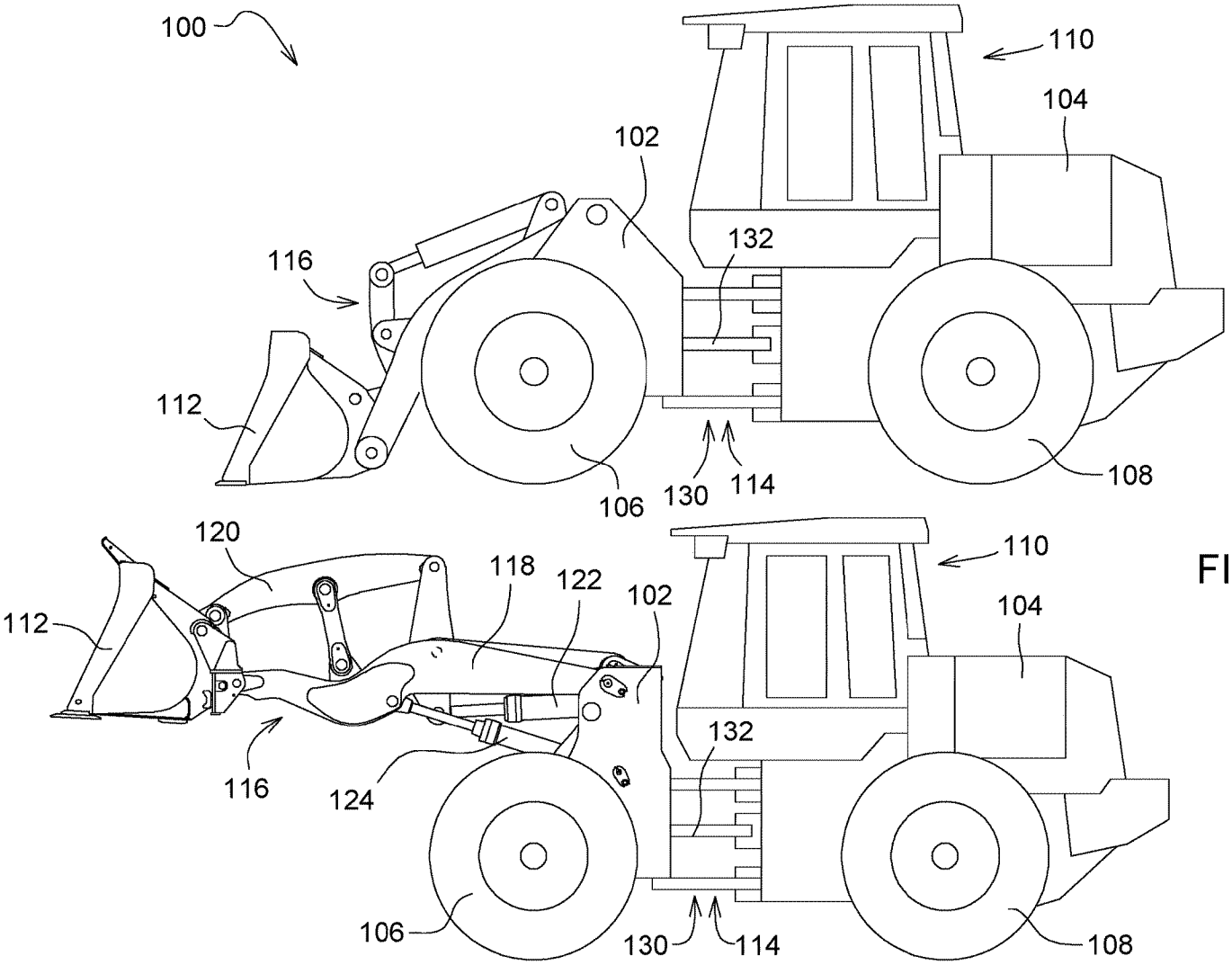
FIG. 1 is a side elevation view of a machine having a system for determining a cycle time of the machine in accordance with one or more embodiments of the present disclosure.

At least one example embodiment of the subject matter of this disclosure is understood by referring to FIGS. 1 through 4 of the drawings. Referring now to FIG. 1, a system 10 for a machine 12 having one or more actuator(s) 14 is provided. The machine 12 in one or more embodiments of the present disclosure includes an excavator, a backhoe loader, crawler, harvester, skidder, motor grader, or any other vehicle or work machine. The machine 12 illustrated in FIG. 1 is a front loader, such as a four-wheel drive loader.

The machine 100 includes a front frame assembly 102 and a rear frame assembly 104 that may be pivotably coupled to one another via an articulation pivot or joint 114. The front frame assembly 102 and the rear frame assembly 104 may pivot or otherwise move relative to each other by means of a steering mechanism 130 in order to allow steering of the machine 100. The steering mechanism 130 includes one or more hydraulic actuators 132 in the illustrated embodiment to actuate movement of the front frame assembly 102 relative to the rear frame assembly 104. These actuators 132 may take the form of a hydraulic lift cylinder. The front frame assembly 102 can be supported by a front ground-engaging mechanism 106 such as a wheel or track. Likewise, the rear frame assembly 104 can be supported by a rear ground-engaging mechanism 108 such as a wheel or track.

The machine 100 of FIG. 1 may also include an operator cab 110 supported by the rear frame assembly 104 to substantially enclose and protect the operator of the machine 100. The operator cab 110 may include a plurality of controls for operating the machine 100. Although not shown in FIG. 1, a steering wheel or joystick may be used to manipulate a direction of travel of the machine 100. In addition, other controls such as joysticks, pedals, switches, buttons, and the like may be used for controlling one or more work functions of the machine 100.

The machine 100 may include at least one work tool, illustratively a first work tool 112 (i.e., a loader bucket) coupled to the front frame assembly 104. Other suitable work tools may be used such as, for example, blades, forks, tillers, and mowers. The work tool or implement 112 may be removably coupled to the front frame assembly 102 for scooping, carrying, and dumping dirt and other materials. The operator may control the work tool or implement 112 via user controls 208 within the operator cab 110. As used herein, the terms "work tool" and "implement" may be used interchangeably, and use of either term herein shall be understood as meaning "work tool" or "implement".

As shown in FIG. 1, the work tool or implement 112 is moveably coupled to the front frame assembly 102 via a linkage assembly 116, which includes at least one boom 118, a linkage or coupler 120, and a plurality of hydraulic actuators 122, 124 for moving the work tool or implement 112 relative to the front frame assembly 102. The plurality of hydraulic actuators 122, 124 may include a first actuator 122 and a second actuator 124. These actuators may take the form of a hydraulic lift cylinder for raising and lowering the boom 118 and a hydraulic tilt cylinder for tilting (e.g. digging and dumping) the work tool or implement 112. As described above, the work tool or implement 112 may be removed from the linkage assembly 116 so that a different work tool or implement (e.g., a blade or forks) may be coupled thereto.

Figure 2:
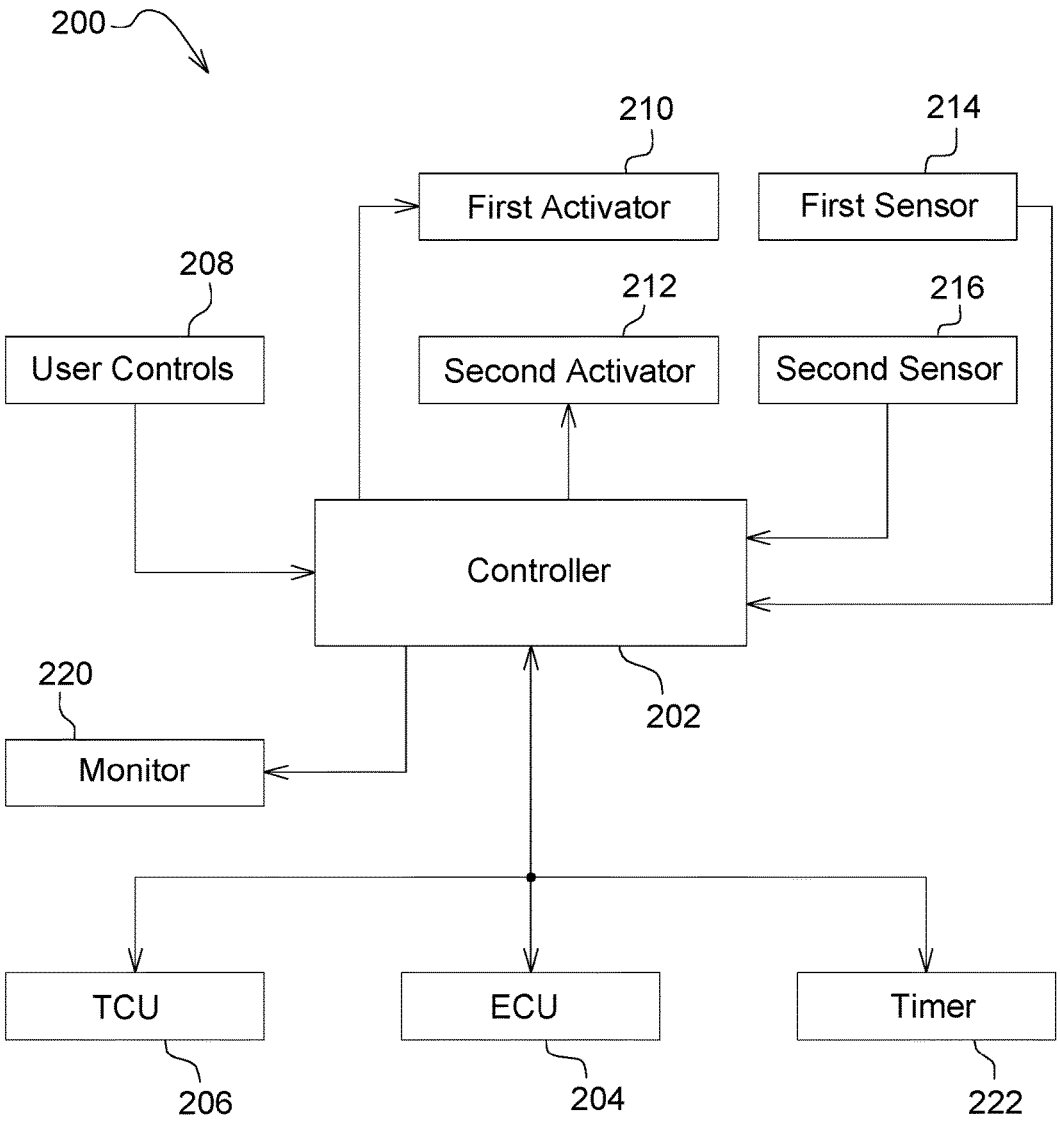
FIG. 2 illustrates a system for determining a cycle time of a machine in accordance with one or more embodiments of the present disclosure.

Referring now to FIG. 2, a control system 200 of a work machine (e.g., such as the loader backhoe 100 in FIG. 1) is provided. The control system 200 may include a machine controller 202 for controlling the functionality of the machine. The controller 202 may include a plurality of inputs and outputs. For instance, the controller 202 may receive commands or instructions from a machine operator via a plurality of user controls 208. The plurality of user controls 208 may include a first user control such as a steering wheel or joystick used for steering or controlling a direction of travel of the work machine. A second user control may be a joystick, lever, pedal, or other known control for controlling a work tool or implement of the work machine. A third user control may be a joystick, lever, pedal, or other known control for controlling a speed and/or engine speed of the work machine. Moreover, a fourth user control may be an ignition switch for a key or a push button, for example, in which the operator triggers the engine of the machine between an on and off condition. Another user control may include a joystick, lever, knob or the like for controlling another work tool or implement. Other user controls may also be incorporated into the control system 200 of FIG. 2, including but not limited to controls for braking, engaging or disengaging a park brake, hydraulic controls, engine controls, transmission controls, etc. The present disclosure is not limited to any number or type of controls. As shown in FIG. 2, the plurality of user controls 208 may be electrically coupled to the controller 202 to allow the machine operator to send commands thereto for controlling the machine.

As described above with reference to FIG. 1, the work machine may include an engine (e.g., engine 104) or prime mover for producing power and a transmission (not shown) for transferring the power to the front and rear wheels. The engine 104 may be controlled by an engine control unit (ECU) 204, which as shown in FIG. 2, may be in electrical communication with the controller 202. Likewise, the transmission may be controlled by a transmission control unit (TCU) 206, which may also be in electrical communication with the controller 202. The ECU 204 and TCU 206 may be electrically coupled to the controller 202 via hard wiring or a wireless connection. In one non-limiting example, the controller 202 may communicate with the ECU 204 and TCU 206 over a communication network such as a controller area network (CAN). As will be further described below, a timing mechanism such as an internal clock or timer 222 may be internally disposed within the controller 202 or otherwise in electrical communication with the controller 202.

Although not specifically shown in FIG. 1 of this disclosure, the work machine may include a display monitor 220 located inside the cab 110 for displaying information to an operator. The monitor 220 may also include a touchscreen or other controls so that an operator may send instructions to the controller 202 for controlling a function of the work machine. As such, the monitor 220 may be in electrical communication with the controller 202 so that messages or instructions may be communicated therebetween.

Similar to the work machine 100 of FIG. 1, the control system 200 may include a first actuator 210 and a second actuator 212 for controlling movement of a work tool, an implement and/or the steering mechanism 130. In additional embodiments not shown, the control system 200 includes any number of additional actuators for controlling movement of one or more additional work tools, implements, steering functions, and/or other vehicle functions. Each actuator may be disposed in electrical communication with the controller 202 such that the controller controls movement of the actuator. In one example, the actuator may be a hydraulic actuator such that control of the implement is electro-hydraulically driven. In another embodiment (not illustrated), each actuator may be manually controlled by the user controls. Other known control systems may be used for controlling movement of the actuator.

In one non-limiting example, the first actuator 210 may control a work tool or implement 112, such as a boom or bucket to name non-limiting examples, the steering mechanism 130, or another structure of the machine 100. Similarly, the second actuator 212 may control a work tool or implement 112, such as a boom or bucket to name non-limiting examples, the steering mechanism 130, or another structure of the machine 100. Although not illustrated, one or more additional actuators may be included to control a work tool, steering mechanism, or other structure of the machine 100. Referring to FIG. 1, for example, the first actuator 210 may correspond with the boom arm 142, and the second actuator 212 may correspond with the steering mechanism 130. This, however, is only one example as it relates to FIG. 1, and this disclosure may cover any agricultural, construction, forestry, or other vehicle or work machine.

The control system 200 may also include a first sensor 214 for detecting movement or a position of the first actuator 210. Likewise, a second sensor 216 may detect movement or a position of the second actuator 212. Similarly, one or more additional sensors may be included to detect positions, movement, and/or other conditions of one or more actuators, work tools, or other vehicle components. In the illustrated embodiment, the first and second sensors 214, 216 are each position sensors. For example, one or both sensors may be located on a linkage assembly, such as the linkage assembly 144 of FIG. 1, or as part of another vehicle assembly, such as the steering mechanism 130. In an illustrative, non-limiting example, one sensor may be an angular position sensor capable of directly detecting the angular position of an actuator or work tool, such as the boom relative to the pin about which it rotates, while the other sensor may detect angular position of a bell crank on a loader (i.e., a Z-bar linkage). Kinematics and the like may be used in addition to the measurement by the sensor to detect a bucket position, for example. Additionally, in-cylinder position sensors may be used for detecting actuator position. In an additional embodiment, one or both of the first and second sensors 214, 216 is a pressure sensor, such as a hydraulic pressure sensor configured to determine a system hydraulic pressure, actuator hydraulic pressure, and/or pressure at any other point in a hydraulic system to name non-limiting examples, to transmit pressure information to the controller 202.

One having ordinary skill in the art will recognize the various structures and methods for determining pressure or actuator position, and such structures and methods form part of the present disclosure. The actuator may be electrical, hydraulic, mechanical, and/or any other known type of actuator. In any event, the first sensor 214, the second sensor 216, and any additional sensor or input device may be disposed in electrical communication with the controller 202 to communicate any pressure information and/or the movement or position of each respective actuator, and, as such, the movement or position of each respective work tool, implement, or steering mechanism, and this may be used on any type of agricultural, construction, forestry, or other known work machine.

Figure 3:
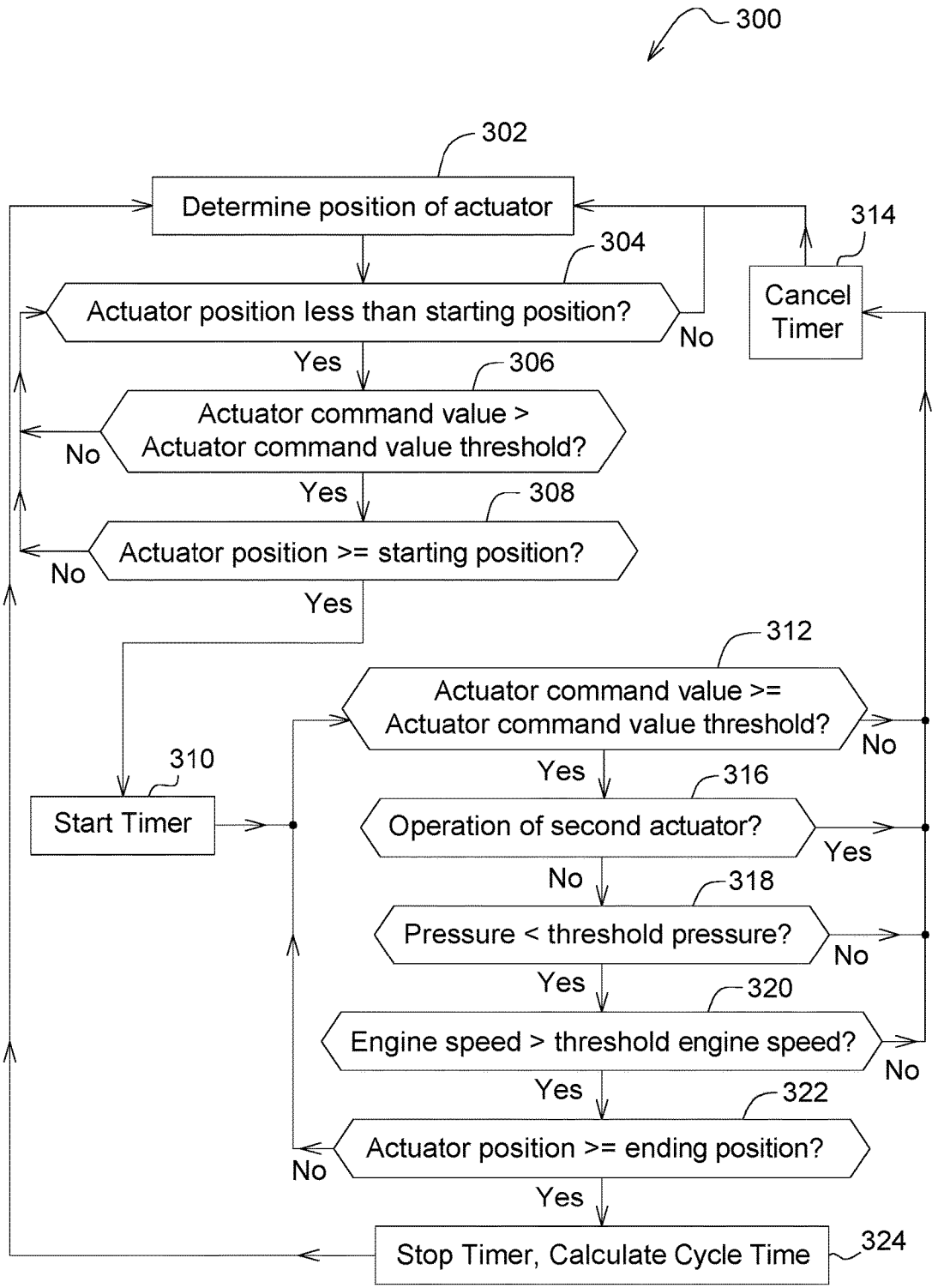
FIG. 3 illustrates s a flow diagram of a system for determining a cycle time of a machine in accordance with one or more embodiments of the present disclosure.

Referring now to FIG. 3, a control method or process 300 is illustrated for determining a cycle time of the actuator 210 of the work machine 100. The control method or process 300 may include a plurality of blocks or steps that are executable by the controller and other features of the control system 200. For purposes of this disclosure, cycle time may refer to an amount of time it takes to move an actuator, work tool, implement, steering mechanism, or other movable structure of the machine 100 from one end or position to an opposite end or position.

A boom, for example, may be controlled from its fully lowered position to its fully raised position, and the cycle time is the amount of time that elapses as the boom moves between the two end positions. A bucket may move from its fully dumped position to its fully curled position, and its cycle time is the amount of time that it takes for the bucket to move between these two positions.

A cycle time test may be executed to identify or determine a possible problem in a hydraulic circuit of the machine. For example, a hydraulic pump may provide flow to an actuator for controlling an implement, work tool, steering mechanism, etc. If there is a lack of expected pump flow output from the pump, there may be problems with pump efficiency or a leak in the system. An operator or technician may detect an issue with the implement due to a slower than expected or desired response. There may be less power delivered to the actuator or implement, and this may affect performance. If the cycle time of the actuator or implement is tested and the result is undesirable or unsatisfactory, there may be a need to check various pump settings such as a pump margin setting or cutoff pressure.

Conventional cycle time testing is often performed by a machine operator or technician using a stopwatch to time the operation of the actuator, work tool, or implement. Operator error or differences in running the test may introduce error into the test. One operator may trigger the stopwatch more quickly, while a second operator may be slower in triggering the stopwatch. If the overall cycle time is less than 10 seconds, for example, an error as great as 0.5 seconds can greatly affect the accuracy of the test.

In accordance with an embodiment of the disclosure, the control process 300 of one or more embodiments described herein is executed autonomously by the controller 202 during operation of the machine 100. The controller 202 is able to measure, store, and/or otherwise determine accurate cycle times by controlling the conditions necessary for a proper cycle time determination. As such, autonomous execution of the process 300 by the controller 202 increases the accuracy of a cycle time measurement, allows recognition, establishment, and/or determination of one or more trends relating to cycle times, and prevents interruption of machine operation as the process 300 is executed in the background by the controller.

In particular embodiments, the control process 300 of one or more embodiments described herein is executed autonomously and repeatedly by the controller 202 during operation of the machine 100. In particular embodiments, the control process 300 of one or more embodiments described herein is executed autonomously and constantly by the controller 202 during simultaneous, normal operation of the machine 100. In other words, in particular embodiments, the control process 300 is executed autonomously by the controller 202 in the background of normal operation of the machine 100.

As will be understood by the present disclosure, the controller 202 of one or more embodiments executes the process 300, determines cycle time values or other data from the process 300 for each of one or more actuators, and stores the data in the controller 202 or in another memory device embedded in or connected to the machine 100. In one or more embodiments, the process 300 and/or controller 202 sends the values or data from the process 300 to the monitor 220 or other output location, further processes the values or data, and/or controls a machine component based on the values or data from the process 300.

The control process 300 of FIG. 3 is executed by the controller 202. At the start of the control process 300, the controller 202 initially determines, at block 302, a position of the actuator 210. The controller 202 then determines, at block 304, whether the actuator position is less than a starting position or a first threshold position. The starting or first threshold position of an embodiment is between 0% and 45% of a full range of movement of the work tool 112 or the actuator 210, between 10% and 30% in an embodiment, and between 15% and 25% in an embodiment. If the controller 202 determines that the actuator position is less than or has not yet reached the starting position or first threshold position, the controller 202 determines in block 306 whether an actuator command value is above an actuator command value threshold. If the actuator command value equal to or less than the actuator command value threshold, the controller 202 returns to monitoring the actuator position at block 304. If the actuator command value is greater than the actuator command value threshold, the controller 202 continues to block 308 to determine whether the actuator position is greater than or equal to the starting position to indicate that the actuator has moved from a position less than the starting or first threshold position to a position equal to or greater than the starting or first threshold position. If the controller 202 determines that the actuator position is greater than or equal to the starting position in block 308, the controller 202 initiates the timer 222 in block 310. Otherwise, the controller 202 returns to block 304 to monitor the actuator position.

Once the controller 202 starts the timer 222 at block 310, the controller 202 continues to monitor the actuator command value, at block 312, to confirm that the command value remains at or above the actuator command value threshold. The actuator command value threshold in an embodiment is a value between 80% and 100%, between 90% and 100% in an embodiment, and 95% in an embodiment. If the command value drops below the threshold, the controller 202 cancels the timer operation at block 314, and the process 300 returns to determining the actuator position at block 302. In the illustrated embodiment, the controller 202 cancels the timer 222 at any point before stopping the timer 222 if the command value drops below the threshold.

The controller 202 further determines, at block 316, whether the second actuator 212 or any additional actuator (s) is/are being operated. Operation of one or more additional actuators may reduce the performance of the actuator 210, thereby affecting an accurate determination of a cycle time of the actuator 210. As such, if the controller 202 determines operation of one or more other actuators during operation of the timer 222, the timer 222 is cancelled at block 314.

The controller 202 further monitors or determines, at block 318, whether an actuator or system pressure, such as a hydraulic pressure in a non-limiting example, is under or less than a threshold pressure. In an embodiment, the controller 202 receives input pressure values from a pressure sensor located at the actuator 210 and/or at any other point of a hydraulic or other system of the machine 100. If the controller 202 determines that the pressure has fallen to or below the threshold pressure, the controller 202 cancels the timer 222 at block 314.

In an embodiment not illustrated, the controller 202 further monitors or determines whether a temperature, such as an oil or hydraulic fluid temperature in a non-limiting example, is under or less than a threshold temperature. In an embodiment, the controller 202 receives input temperature values from a temperature sensor located at the actuator 210 and/or at any other point of a hydraulic, engine, or other system of the machine 100. If the controller 202 determines that the temperature risen to or above the threshold temperature, the controller 202 does not initiate or cancels the timer 222 in an embodiment.

The controller 202 further monitors or determines, at block 320, a speed of the engine 104 of the machine 100 and determines whether the engine speed is above a threshold engine speed. In an embodiment, the controller 202 receives input engine speed values from an engine speed sensor located at the engine 104. If the controller 202 determines that the engine speed has fallen to or below the threshold engine speed, the controller 202 cancels the timer 222 at block 314.

When the controller 202 determines, at block 322, that the position of the actuator 210 has met or exceeded an ending position or second threshold position, the controller 202 stops the timer at block 324 and calculates or otherwise determines a cycle time. The ending or second threshold position of an embodiment is between 55% and 100% of a full range of movement of the work tool 112 or the actuator 210, between 70% and 90% in an embodiment, and between 75% and 85% in an embodiment.

In the illustrated embodiment, determining the cycle time at block 324 includes calculating the cycle time by extrapolating a full cycle time based upon the time period recorded from the starting, or first threshold position to the ending, or second threshold position. Because the starting and ending positions of the process 300 do not equate to the extreme ends of the movement range of the actuator 210 or work tool 112, the time period measured by the timer 222 is less than an actual cycle time of the actuator 210 or work tool 112. To calculate or otherwise determine the cycle time in block 324, the controller 202 extrapolates or otherwise deduces a cycle time based upon the time measured by the timer 222.

In a first example, the first threshold position may correspond with 10% travel and the second threshold position may correspond with 90% travel. Thus, the cycle time is measured over the course of 80% of the entire stroke of the actuator cylinder. Stated another way, the measured cycle time between starting and stopping the timer corresponds with the actuator or work tool moving 80% of the total distance travelled between the start and end positions. If the work tool is a boom, for example, the timer is started when the boom travels from its fully lowered position to a position 10% of the way to the fully raised position, and the timer is stopped when the boom travels from its fully lowered position to a position 90% of the way to the fully raised position. In this example, the full cycle time may be calculated by dividing the measured cycle time by the percentage of distance measured. So, if the measured cycle time is 5 seconds and the measured distance is 80%, the full cycle time is 5 seconds divided by 0.8 resulting in a full cycle time of 6.25 seconds.

In a second example, the first threshold position may correspond with 20% travel and the second threshold position may correspond with 80% travel. Thus, the cycle time is measured over the course of 60% of the entire stroke of the actuator cylinder (e.g., 80% minus 20%). Stated another way, the measured cycle time between starting and stopping the timer corresponds with the work tool moving 60% of the total distance travelled between the start and end positions. If the work tool is a boom, for example, the timer is started when the boom travels from its fully lowered position to a position 20% of the way to the fully raised position, and the timer is stopped when the boom travels from its fully lowered position to a position 80% of the way to the fully raised position. Similar to the first example, the full cycle time may be calculated by dividing the measured cycle time by the percentage of distance measured. So, if the measured cycle time is 5 seconds and the measured distance is 60%, the full cycle time is 5 seconds divided by 0.6 resulting in a full cycle time of 8.33 seconds.

Once the cycle time is determined, the controller 202 further records, stores, or otherwise retains the cycle time data. The controller 202 of the illustrated embodiment stores the cycle time data in an internal memory, but the controller 202 of additional embodiments may transmit or otherwise communicate the data to an external location for storage, processing, and/or other purposes. As the controller 202 repeatedly and constantly executes the process 300 during operation of the machine 100, the controller 202 may simultaneously or later create a collection or compilation of the cycle time data, further process or filter the cycle time data, and/or create trend data or other processed data based on the collection of multiple cycle time values. Any of the data or values described herein may be stored internal or external to the controller 202 or internal or external to the machine 100, transmitted or displayed internally or externally, or processed to implement additional action by the controller 202 or the machine 100.

In one non-limiting illustrative example, after execution of the process 300 during normal operation of the machine 100, the cycle time data is downloaded from the controller 202 or other memory device of the machine 100 by an operator or a service technician during routine maintenance of the machine 100 or transmitted or otherwise accessed during normal operation of the machine 100. In accordance with the present disclosure, the operator or service technician observes cycle time data for any one or more actuators of the machine 100 and any cycle time trends or other information provided by the controller 202 and diagnoses or otherwise determines one or more potential issues, statuses, or characteristics with the machine 100. In the non-limiting example, a technician may observe a hydraulic pump beginning to fail in the machine 100 as indicated by a recent reduction in cycle times.

In additional embodiments, the controller 202 may receive, determine, and/or store data associated with or accompanying the cycle time, including, without limitation, geographic location, time of day, elevation, surface grade, temperature, and/or humidity to name non-limiting examples. Such additional accompanying data may be processed to create or observed to recognize trends associated with the actuator 210 or the machine 100. The controller 202 of particular embodiments determines, generates, and/or communicates a general or specific alert or status based on processing the time cycle data, with or without the accompanying data.

Once the full cycle time is determined in block 324, the controller 202 may communicate the full cycle time. In one example, the controller 202 may communicate the cycle time to the operator by displaying it on the display monitor 220. In another example, the controller 202 may send the cycle time to a remote location, such as to a mobile device in a non-limiting example, via a wireless communication network so that the cycle time may be logged and tracked. In an embodiment, the controller 202 may compare the cycle time to a cycle time threshold and send an alert based on the comparison.

Figure 4:
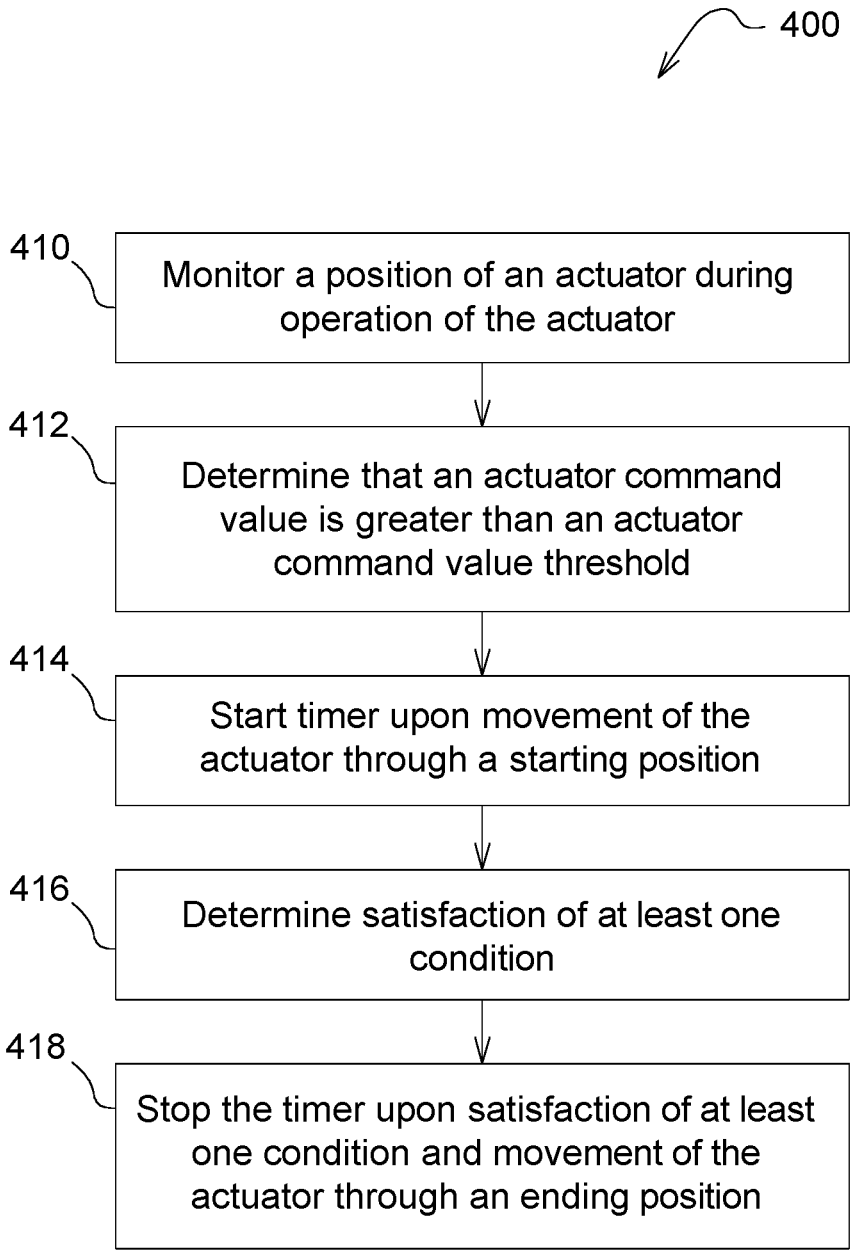
FIG. 4 illustrates a method of determining a cycle time of a machine in accordance with one or more embodiments of the present disclosure.

Referring now to FIG. 4, a method 400 of determining a cycle time of the actuator 210 is provided. The method 400 of one or more embodiments of the present disclosure, like the process 300 described above, is executed autonomously and constantly during operation of the machine 100. In one embodiment, an operator, technician, or other user does not initiate the process 300 or method 400, and the controller 202 or machine 100 does not prompt or instruct a user to initiate a cycle time test before the controller 202 executes a cycle time test. In another embodiment, the process 300 and/or the method 400 is configured to run constantly and repeatedly. In another embodiment, the step of determining or calculating an individual cycle time occurs multiple times, and any step of storing or processing an individual cycle time, if applicable, occurs multiple times, before a collection of information or trend information based on the individual cycle times is displayed, downloaded, or transmitted for processing, diagnosing, evaluation, alerting, or further consideration.

The method 400 of an embodiment includes determining or monitoring, at step 410, a position of the actuator during operation of the actuator 210. As described above, the controller 202 of an embodiment receives or otherwise determines the position of the actuator 210 during execution of the process 300 during normal operation of the machine 100. The method 400 further includes determining, at step 412, that an actuator command value is greater than an actuator command value threshold. As stated above, the actuator command value threshold of an embodiment is a value between 80% and 100%, between 90% and 100% in an embodiment, and 95% in an embodiment. The method 400 further includes starting, at step 414, the timer 222 upon movement of the actuator 210 through a starting position, determining, at step 416, the satisfaction of one or more conditions, and stopping the timer 222 upon satisfaction of the one or more conditions and upon movement of the actuator 210 through an ending position. The one or more conditions in the illustrated embodiment includes the actuator command value being greater than the actuator command value threshold, the operation of a second actuator, a pressure, such as a hydraulic pressure in the actuator or elsewhere in the system in a non-limiting example, being greater than a threshold pressure, and/or a machine engine speed being greater than a threshold engine speed, as described above with reference to FIG. 3. The method 400 of an additional embodiment includes determining that the one or more condition(s) has/have not been satisfied, and cancelling the timer upon the determination that the condition(s) has/have not been satisfied. The method 400 of one or more embodiments described herein incorporates any functions, steps, structures, or features described with regard to the embodiments of the system 300 described above.

Without in any way limiting the scope, interpretation, or application of the claims appearing below, a technical effect of one or more of the example embodiments disclosed herein is the generation of highly accurate cycle time data for the machine 100. Such generation or determination of highly accurate cycle time data occurs without machine downtime or interruption to the normal operation of the machine 100. A further technical effect of one or more of the embodiments disclosed herein involves the generation or determination of one or more trends relating to the cycle times.

While the present disclosure has been illustrated and described in detail in the drawings and foregoing description, such illustration and description is not restrictive in character, it being understood that illustrative embodiment(s) have been shown and described and that all changes and modifications that come within the spirit of the present disclosure are desired to be protected. Alternative embodiments of the present disclosure may not include all of the features described yet still benefit from at least some of the advantages of such features. Those of ordinary skill in the art may devise their own implementations that incorporate one or more of the features of the present disclosure and fall within the spirit and scope of the appended claims.

What is claimed is:

1. A method comprising:

monitoring a position of an actuator during operation of the actuator;

determining that an actuator command value is greater than an actuator command value threshold;

starting a timer upon a movement of the actuator through a starting position during the operation of the actuator at the actuator command value;

determining satisfaction of at least one condition; and stopping the timer upon satisfaction of the at least one condition and movement of the actuator through an ending position.

2. The method of claim 1, wherein the actuator comprises one of a work tool actuator and a steering actuator.

3. The method of claim 2, further comprising:

determining that the at least one condition has not been satisfied; and cancelling the timer upon the determination that the at least one condition has not been satisfied.

4. The method of claim 3, wherein the at least one condition comprises the actuator command value being greater than the actuator command value threshold.

5. The method of claim 3, wherein the at least one condition comprises an operation of a second actuator.

6. The method of claim 3, wherein the at least one condition comprises a fluid pressure being greater than a threshold fluid pressure.

7. The method of claim 2, wherein the at least one condition comprises a machine engine speed being greater than a threshold engine speed.

8. A method comprising:

operating one of a work tool and a steering mechanism of a machine through at least one threshold position;

operating a timer based upon operation of the one of the work tool and the steering mechanism through the at least one threshold position and at least one first condition; and determining a cycle time of the one of the work tool and the steering mechanism based on the operation of the timer.

9. The method of claim 8, further comprising receiving a command value, wherein the first condition comprises the command value being greater than a threshold command value.

10. The method of claim 8, wherein the at least one threshold position comprises a first threshold position and a second threshold position, and operating the timer comprises starting the timer upon operation of the one of the work tool and the steering mechanism through the first threshold position and stopping the timer upon operation of the one of the work tool and the steering mechanism through the second threshold position.

11. The method of claim 10, further comprising cancelling the timer based at least partially on at least one second condition.

12. The method of claim 11, wherein the second condition comprises a command value being less than a threshold command value, an operation of a second actuator, a fluid pressure being greater than a threshold fluid pressure, and a machine engine speed being less than a threshold engine speed.

13. A system for determining a cycle time of a machine having an actuator configured to operate at least between a first threshold position and a second threshold position, the system comprising:

a controller configured to continuously monitor a position of an actuator during operation of the machine;

determine satisfaction of a first condition;

measure, upon monitoring the position of the actuator operating from the first threshold position to the second threshold position, a time for the actuator to operate from the first threshold position to the second threshold position; and determine a cycle time of the actuator based upon the actuator operating from the first threshold position to the second threshold position.

14. The system of claim 13, wherein the controller is further configured to receive an actuator command value; and command actuation of the actuator based upon the actuator command value.

15. The system of claim 14, wherein the first condition comprises the actuator command value being greater than a threshold actuator command value.

16. The system of claim 13, wherein the controller is further configured to determine the cycle time when at least one second condition is satisfied.

17. The system of claim 16, wherein the at least one second condition comprises the actuator command value being greater than a threshold command value.

18. The system of claim 16, wherein the at least one second condition comprises non-operation of a second actuator.

19. The system of claim 16, wherein the at least one second condition comprises a fluid pressure being less than a threshold fluid pressure.

20. The system of claim 16, wherein the at least one second condition comprises a machine engine speed being greater than a threshold engine speed.

* * * * *